US006991387B2

(12) United States Patent
Kida

(10) Patent No.: US 6,991,387 B2
(45) Date of Patent: Jan. 31, 2006

(54) PRINTING APPARATUS AND PRINTING POSITION ADJUSTMENT METHOD

(75) Inventor: Akira Kida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/925,973

(22) Filed: Aug. 26, 2004

(65) Prior Publication Data

US 2005/0058493 A1 Mar. 17, 2005

(30) Foreign Application Priority Data

Aug. 29, 2003 (JP) ..... 2003-308005

(51) Int. Cl.
*B41J 11/44* (2006.01)

(52) U.S. Cl. ..... 400/76; 400/74; 400/579; 101/481; 101/485; 347/19; 347/116

(58) Field of Classification Search ..... 400/76, 400/74, 70, 61, 579; 347/19, 116; 101/481, 101/486, 485
See application file for complete search history.

(56) References Cited

U.S. PATENT DOCUMENTS 6,065,400 A * 5/2000 Van Weverberg ..... 101/181
6,084,606 A * 7/2000 Moriyama ..... 347/19
6,092,939 A * 7/2000 Nishikori et al. ..... 400/61
6,257,143 B1 * 7/2001 Iwasaki et al. ..... 101/481
6,409,301 B1 * 6/2002 Takata et al. ..... 347/19
6,416,151 B1 7/2002 Otsuka et al. ..... 347/19

FOREIGN PATENT DOCUMENTS

JP 11-291477 10/1999

* cited by examiner

*Primary Examiner*—Minh Chau
(74) *Attorney, Agent, or Firm*—Fitzpatrick, Cella, Harper & Scinto

(57) ABSTRACT

In a printing sheet conveying direction, registration adjustment patterns can be printed in a large area on a printing sheet and can be read. Specifically, along a first feeding path, printing heads print registration adjustment patterns in a first area on a printing sheet, and a sensor measures the densities of the patterns on the printing sheet after it has been reversely fed. A printing sheet can be reversely fed along a horizontal second feeding path without contacting the PE sensor lever. In this state, the printing sheet is fed in the forward direction so that a second area for printing registration adjustment patterns is adjacent to the area A, and the printing heads sequentially print registration adjustment patterns. The printing sheet is then reversely conveyed a predetermined distance and the densities of the patterns are measured.

5 Claims, 9 Drawing Sheets

PRINTING APPARATUS AND PRINTING POSITION ADJUSTMENT METHOD

BACKGROUND OF THE INVENTION

1. Field of the Invention

The present invention relates to a printing apparatus, and more specifically, to a printing apparatus comprising a device for reading the results of printing performed on a printing medium such as a printing sheet, so that the printing position can be automatically adjusted.

2. Description of the Related Arts

A printing position adjustment technique is known whereby a position relation between respective dots formed by a printing head during forward and backward scans are adjusted to be normal, or whereby a position relation between respective dots formed by a plurality of printing heads are adjusted to be normal. One of specific position adjustment processes, in the case for the forward and backward scans, is such that predetermined patterns each composed of respective dots formed during the forward and backward scans are respectively printed on a plurality of printing sheets at different timings of dot formation, and are read by an optical measurement device. Then, based on the reading results, a pattern that realizes the best position relation of the respective dots is selected, and the formation timing for this pattern is employed to designate a dot formation timing for the printing process. The position adjustment for a plurality of printing heads can be performed substantially in the same manner. Hereinafter, this position adjustment process is called a registration adjustment, or an automatic registration adjustment, as opposed to a user performed registration adjustment. An example automatic registration adjustment process is described in Japanese Patent Application Laid-open No. 11-291477 (1999).

According to Japanese Patent Application Laid-open No. 11-291477 (1999), a sensor constituting an optical measurement device is located at a downstream side of a printing head in a direction in which a printing sheet is fed, and therefore a pattern printed for the registration adjustment can be read while the printing sheet is being fed in the same direction as for usual printing.

There is another apparatus wherein, in order to reduce the apparatus size, a sensor functioning as an optical measurement device is located at an upstream side, in the feeding direction, of a printing head. This apparatus can not read a registration adjustment pattern in a single feeding direction, unlike the apparatus in Japanese Patent Application Laid-open No. 11-291477 (1999). So in this case, it is viewed as a printing sheet bearing a registration adjustment pattern is fed in the reverse direction to permit the sensor to read the pattern. However, a defect, such as a so-called paper jam, may occur when a printing sheet is reversely fed.

More specifically, for a general printing apparatus, an automatic sheet feeder separates one printing sheet and supplies the separated sheet. Then, a feeding mechanism feeds the printing sheet to a printing area for a printing head and successively feeds the printing sheet in the same direction so that a printing operation is performed for the printing sheet. For this configuration, when the printing sheet is reversely fed, the print sheet is fed along a feeding path extending from the automatic sheet feeder to the printing area. As a result, the edge of the printing sheet may be caught by a paper detection sensor located along the feeding path, a separation unit in the automatic sheet feeder, guides forming the feeding path, or the like, so holding of the print sheet or a paper jam may occur, which prevents the registration adjustment pattern printed by the printing head from being measured correctly.

Especially when a large proportion of the area of a printing sheet is required for the printing of registration patterns, the distance in the reverse feeding direction must be extended, and accordingly, the probability a paper jam or the like will occur is increased. For example, to print on a printing sheet multiple patterns for which the dot formation timings differ, a very large printing area is required. In addition, these patterns are required for the individual printing heads provided in accordance with the types of printing materials, such as ink. Furthermore, when a large printing area on a printing sheet is available for the printing of registration adjustment patterns, the degree of freedom with which patterns are positioned on the printing sheet can be increased. When, however, a large area is not available for the printing of registration adjustment patterns, and when, to avoid the paper jam or the like, a printing sheet is reversely fed only a short distance, multiple registration adjustment patterns, which should be printed on a single printing sheet, must be printed on a plurality of printing sheets.

On the other hand, according to one proposal advanced for avoiding the reverse feeding that may cause the paper jam or the like, a printing sheet on which the registration patterns are printed is again loaded into the automatic sheet feeder and fed to the measurement area for the sensor. In this case, however, the reloading of the printing sheet must be performed by the user.

SUMMARY OF THE INVENTION

An object of the present invention is to provide a printing apparatus that has a configuration wherein a sensor for reading registration adjustment patterns is located at an upstream side of a printing head in a printing sheet feeding direction, that can print registration adjustment patterns within a very large area on a single printing sheet and read the patterns, and that requires no user's operation for a registration adjustment.

In the first aspect of the present invention, there is provided a printing apparatus that uses a printing head to perform printing on a printing medium which is fed, the apparatus comprising:

a first feeding path along which the printing medium is fed to perform printing on the printing medium;

a second feeding path including a part of the first feeding path and a feeding path different from the first feeding path;

feeding means for feeding the printing medium along the first and the second feeding paths;

detecting means for detecting an image printed on the printing medium on the first and the second feeding paths; and control means for controlling a registration adjustment process through which printing position by the printing head is adjusted, the control means causing the feeding means to feed the printing medium along the second feeding path so as to print at least a part of a pattern image for the registration adjustment on the printing medium using the printing head, causing the feeding means to feed the printing medium along the second feeding path in an opposite direction to a direction in which the printing medium is fed for printing the pattern image so that the detecting means detects the pattern image printed on the printing medium, and executing a registration adjustment of the printing position by the printing head, based on a result of detection by the detecting means.

In the second aspect of the present invention, there is provided a printing position adjustment method for a printing apparatus that uses a printing head to perform printing on a printing medium which is fed, the apparatus including: a first feeding path along which the printing medium is fed to perform printing on the printing medium; a second feeding path including a part of the first feeding path and a feeding path different from the first feeding path; feeding means for feeding the printing medium along the first and the second feeding paths; and detecting means for detecting an image printed on the printing medium on the first and the second feeding paths, the method comprising:

a control step for controlling a registration adjustment process through which printing position by the printing head is adjusted, the registration control step causing the feeding means to feed the printing medium along the second feeding path so as to print at least a part of a pattern image for the registration adjustment on the printing medium using the printing head, and causing the feeding means to feed the printing medium along the second feeding path in an opposite direction to a direction in which the printing medium is fed for printing the pattern image so that the detecting means detects the pattern image printed on the printing medium; and an adjustment step for executing a registration adjustment of the printing position by the printing head, based on a result of detection by the detecting means, wherein the control step causes the feeding means to feed the printing medium along the first feeding path to print a part of a pattern image for the registration adjustment on the printing medium using the printing head, causes the feeding means to feed the printing medium along the first feeding path in an opposite direction to a direction in which the printing medium is fed for printing the pattern image so that the detecting means detects the pattern image printed on the printing medium, and causes the feeding means to feed the printing medium along the second feeding path so as to print the rest of the pattern image the part of which has been printed.

According to the above feature, in the registration adjustment process for adjusting the printing position of the printing head, a printing medium is fed along a second feeding path that differs from a first feeding path used to feed a printing medium during a printing process, and at least a part of a pattern image is printed for the adjustment of the printing position. Then, the printing medium is fed in the direction opposite to that in which the pattern image is printed, and the pattern image on the printing medium is detected. According to this arrangement, even when the distance for which the printing medium is fed along the first feeding path in the reverse direction for detecting the pattern image is narrowed and then only a small area on the printing medium is available for printing the pattern image, at least a part of the pattern image can be printed along the second feeding path and the reverse feeding distance along the second feeding path for detecting the pattern image can be obtained. Therefore, as a whole, the pattern image can be printed in a large area on the printing medium.

As a result, it is possible to provide a printing apparatus that has a configuration wherein a sensor for reading registration adjustment patterns is located at an upstream side of a printing head in a printing sheet feeding direction, that can print registration adjustment patterns within a very large area on a single printing sheet and read the patterns, and that requires no user's operation for a registration adjustment.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The preferred embodiments of the present invention will now be described in detail while referring to the accompanying drawings.

(First Embodiment)

Figure 1:
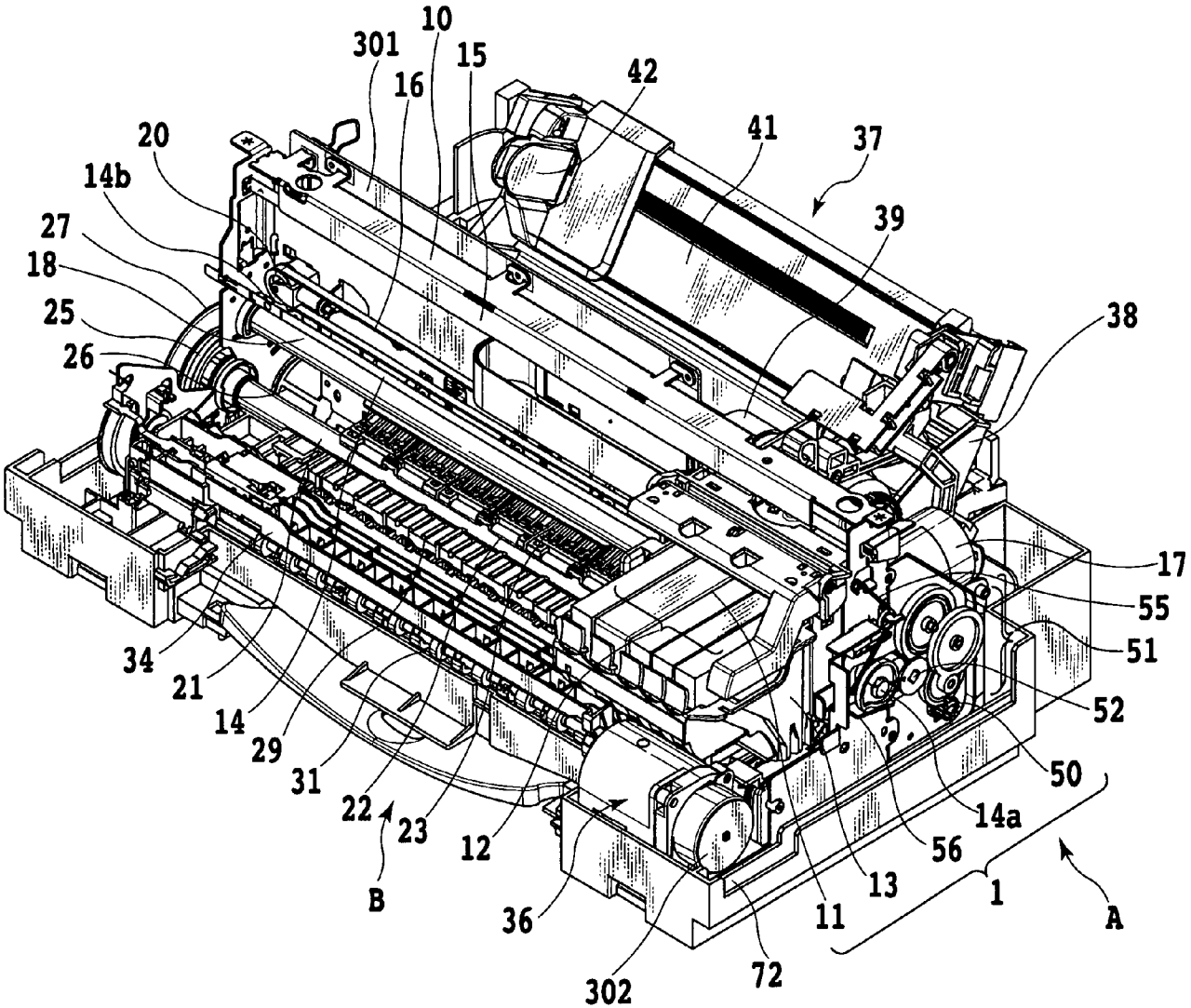
FIG. 1 is a perspective view of an ink jet printer according to a first embodiment of the present invention.
Figure 2:
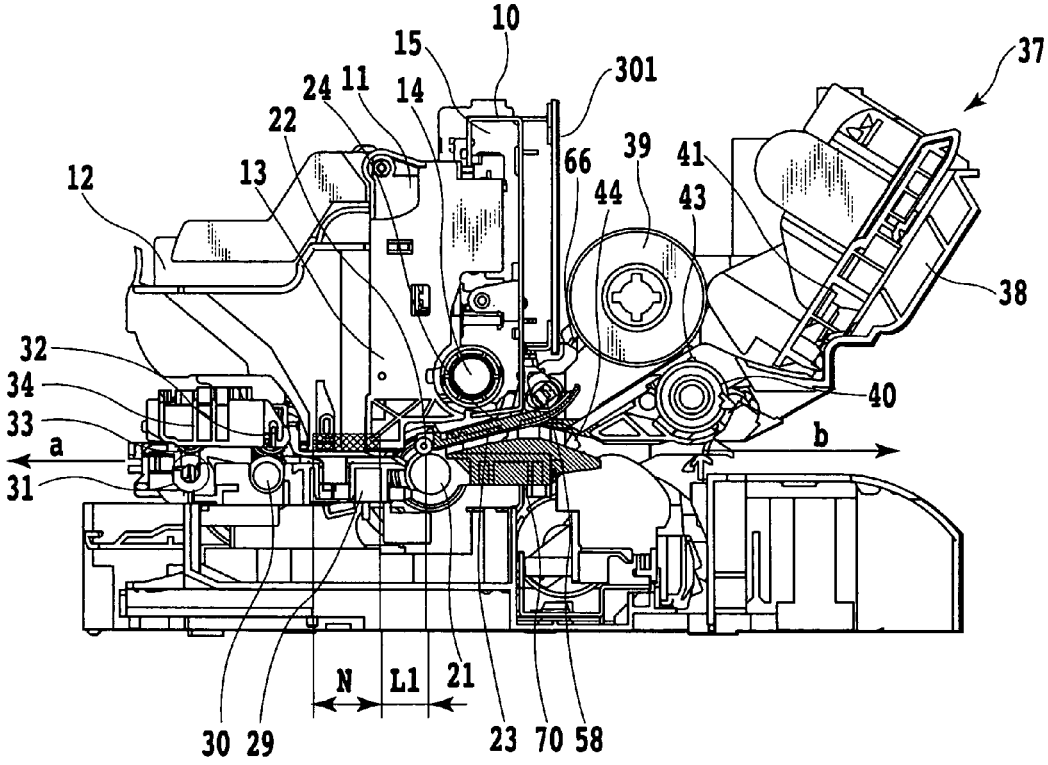
FIG. 2 is a side cross-sectional view of the ink jet printer viewed in the direction indicated by and arrow A in FIG. 1.

FIG. 1 is a perspective view of an ink jet printer that is a printing apparatus according to a first embodiment of the present invention. FIG. 2 is a side cross-sectional view of the ink jet printer viewed in the direction indicated by an arrow A in FIG. 1.

In FIGS. 1 and 2, a head unit 11 is provided with printing heads (not shown), which are prepared for individual colored inks to eject ink for printing, at the lower portion of the head unit, and with ink tanks 12 retaining different colors of ink, which are detachably mounted on the head unit. A carriage 13, on which the head unit 11 with the ink tanks 12 is mounted, can be moved for scanning. Specifically, the carriage 13 is slidably supported by a guide shaft 14 and a guide rail 15 parallel to the guide shaft 14, and is connected to a part of a carriage belt 16, which is driven by a carriage (CR) motor 17 via an idler pulley 20. With this structure, the carriage 13 can be moved along the guide shaft 14, thereby enabling printing head scanning A code strip 18 is provided to detect the position of the mobile carriage 13. Five ink types are used in this embodiment: yellow (Y), magenta (M), cyan (C), black (K) and pigment black (pig K), and accordingly, as is shown in FIG. 1, five ink tanks 12 are provided. The printing heads are also prepared in consonance with the five types of ink, and as will be described later while referring to FIG. 5, seven orifice arrays are arranged for ink colors, with the orifice arrays for predetermined ink colors being arranged symmetrically.

A mechanism for feeding a printing medium, such as a printing sheet, to an area for scanning by the printing heads has the following components. A conveying roller 21 and a pinch roller 22, which is coupled with the conveying roller 21 while pressing a printing sheet against the conveying roller 21, are located upstream of the scanning area for the printing heads along a printing sheet feeding path. A pinch roller holder 23 rotatably supports the pinch roller 22, and a pinch roller spring 24 generates a pressing force for the pinch roller 22 relative to the conveying roller 21. A conveying roller pulley 25 is fixed to the conveying roller 21, an LF motor 26 drives the conveying roller 21, and a code wheel 27 detects the rotation angle of the conveying roller 21. A set consisting of a first discharge roller 30 and a first spur gear spring 32 for pressing a printing sheet against the discharge roller 30 and a set consisting of a second discharge roller 31, which is located downstream of the first discharge roller 30, and a second spur gear spring 33 pressing a printing sheet against the second discharge roller 31 are located downstream of the scanning area for the printing heads. A spur gear base 34 rotatable supports the first and the second spur gear springs 32 and 33. And located immediately below the scanning area for the printing heads, a platen 29 forms a feeding path for printing sheets and for holding fed printing sheets flat.

A supply mechanism for supplying printing sheets is provided relative to the feeding mechanism. A main ASF 37, constituting the entire supply mechanism, mounts multiple printing sheets and separates and feeds them individually. An ASF base 38 is a structural member of the main ASF 37, a supplying roller 39 contacts and feeds the mounted printing sheets to a separation roller 40 that separates them so they can be fed individually, and a pressure plate 41 is used to mount printing sheets and to urge them toward the feeding roller 39. A side guide 42 is provided on the pressure plate 41 to align printing sheets in accordance with an arbitrary width, a return pawl 43 returns to a predetermined position the leading edge of a printing sheet that is fed and extends from the nip portion formed by the supply roller 39 and the separation roller 40, and an ASF flap 44 guides a printing sheet so its passage is limited to a single direction.

The above described supply mechanism feeds a printing sheet to the nip portion formed by the conveying roller 21 and the pinch roller 2. Along this feeding path, a PE sensor lever 66 is provided that contacts and detects the presence of a printing sheet that is being fed, and arranged below the sheet feeding path, for the printing apparatus in this embodiment, is a substantially horizontal feeding path. As will be described later while referring to FIGS. 6 and 7A to 7D, the above described feeding mechanisms, such as the conveying roller 21, can feed a printing sheet along the sheet feeding path or the horizontal feeding path arranged below it, in a direction opposite to that in which a printing sheet is fed for printing. For reverse feeding using one of these feeding paths, the PE sensor lever is retracted to a predetermined position to prevent it from interrupting the reverse feeding of a printing sheet. Further, as a relevant mechanism, a lift input gear 50 engages an ASF planetary gear 49, and a lift reduction gear spring 51 reduces and transmits the drive power provided by the lift input gear 50. A lift cam gear 52 is directly connected to a lift cam shaft; a guide shaft spring 55 is used to urge the guide shaft 14 to one side; a guide slope 56 is used along which the cam of the guide shaft gear 53 slides; a lift cam shaft 58 lifts the pinch roller holder 23; and a sheet guide 70 guides the leading edge of a printing sheet to the nip portion formed by the conveying roller 21 and the pinch roller 22.

A maintenance unit 36 is located at one end of the area through which the carriage 13 is moved. The maintenance unit 36 prevents the clogging of the orifices in the printing heads, and also supplies suction to the printing heads when ink tanks 12 are replaced, so that the nozzles of the printing heads can be satisfactorily filled with ink. The above described printer body 1 also includes, as structural members, a chassis 10 and a base 72, and a control board 301 that is attached to the chassis 10.

Figure 3:
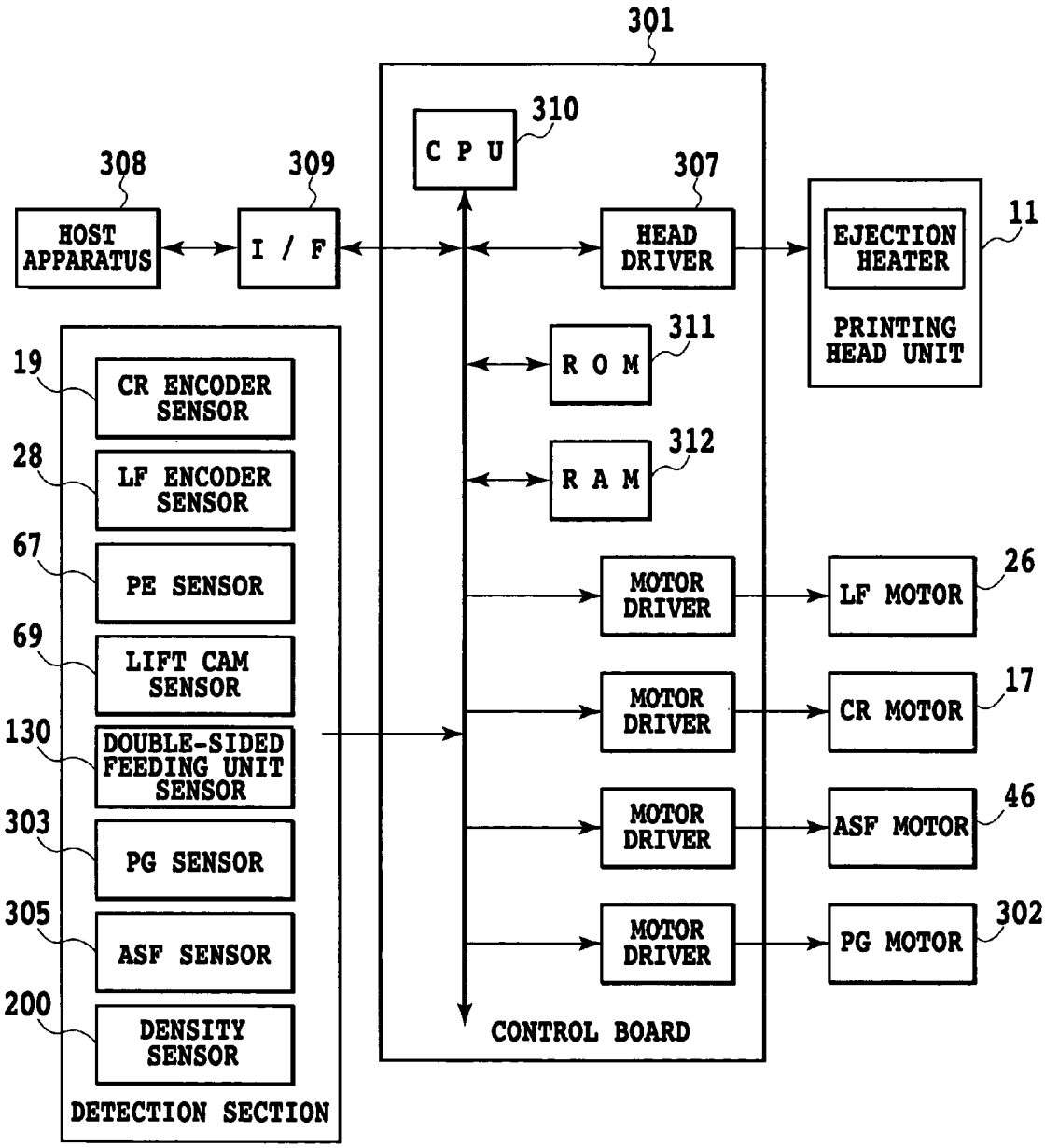
FIG. 3 is a block diagram showing the control configuration for the ink jet printer.

FIG. 3 is a block diagram showing the control configuration of the ink jet printer according to the first embodiment.

In FIG. 3, in accordance with programs stored in a ROM 311, a CPU 310 controls the individual sections of the printer and performs various processes, such as a registration adjustment process that will be described later, and a RAM 312 is employed as a work area for the CPU 310.

The detection unit of the ink jet printer includes: a CR encoder sensor 19, mounted on the carriage 13 to read the code strip 18; an LF encoder sensor 28, attached to the chassis 10 to read the code wheel 27; a PE sensor 67, for detecting the movement of the PE sensor lever 66; a lift cam sensor 69, for detecting the movement of the lift cam shaft 58; a double-sided feeding unit sensor 130, for detecting the attachment or removal of an automatic double-sided feeding unit; a PG sensor 30, for detecting the operation of the maintenance unit 36; an ASF sensor 305, for detecting the operation of the main ASF 37; and a density sensor 200, for reading the densities of predetermined registration adjustment patterns during the registration adjustment process. The detection signals output by these sensors are transmitted to a controller provided on the control board 301, and the CPU 310 performs processes consonant with the signals, which will be described later.

The CPU 310 controls, through motor drivers the rotation of the LF motor 26, for driving the rollers of the conveying mechanism, the CR motor 17, for moving the carriage 13, an ASF motor 46, for driving the feeding roller 39 of the main ASF 37, and a PG motor 302, for driving the maintenance unit 36. Further, the CPU 310 controls, in accordance with corresponding printing data, a head driver 307 for ejecting ink from the printing heads of the head unit 11. The printing heads also eject ink for the printing of the registration adjustment patterns, which will be described later.

A host 308 transmits printing data to the ink jet printer, and an I/F 309 is used for the exchange of data and control signals by the host 308 and the ink jet printer.

The operation of the ink jet printer having the configuration shown in FIGS. 1 to 3 will now be described in detail while referring to FIGS. 1 to 3.

The data received from the host 308 is stored in the RAM 312 via the I/F 309, and consonant with the transfer of this data, the CPU 310 issues a printing start instruction to initiate the printing operation.

When the printing operation is begun, first, the main ASF 37 performs the feeding operation. That is, one printing medium, such as a printing sheet, is separated from a bundle of printing media mounted on the pressure plate 41 and fed. Specifically, in accordance with a feeding operation start instruction, the ASF motor 46 is rotated forward, and the drive power rotates, via the gear springs, the cam that supports the pressure plate 41. When the cam is disengaged by this rotation, the pressure plate 41 is urged toward the supply roller 39 by a pressure plate spring. At the same time, the supply roller 39 is rotated in the sheet feeding direction, so that the feeding of the topmost sheet is begun. Sometimes, depending on the friction force exerted between the printing sheets or the adhesive force between the printing sheets, multiple printing sheets may be fed at the same time. In this case, the separation roller 40, which is pressed against the supply roller 39 and which has a predetermined return rotation torque in the direction opposite to that in which a sheet is fed, acts on the printing sheets, and except for the printing sheet nearest the supply roller 39, returns the printing sheets to the pressure plate 41. When the ASF feeding operation has been completed, the separation roller 40 is released from the supply roller 39 by the cam, and is separated from it a predetermined distance. During this time, the return pawl 43 is rotated to correctly return the printing sheets to a predetermined position on the pressure plate 41. Through this processing, only the topmost printing sheet is fed to the conveying mechanism. When a printing sheet is fed from the main ASF 37, its leading edge is brought into contact with and pushes away and passes the ASF flap 44, which is urged, by an ASF flap spring, in the direction of a position whereat it blocks the sheet traveling path. As the printing for the fed printing sheet is performed, the trailing edge of the printing sheet passes the ASF flap 44, permitting the urging applied to the ASF flap 44 to return it to its original position, blocking the sheet traveling path. Therefore, a printing sheet that is fed in the reverse direction can be prevented from returning to the main ASF 37.

The printing sheet fed by the main ASF 37 is fed to the nip portion formed by the conveying roller 21 and the pinch roller 22 of the sheet conveying mechanism. That is, since the pinch roller 22 is eccentrically located relative to the conveying roller 21 and is slightly offset toward the first discharge roller 30, the printing sheet is slightly tilted, at a tangent angle, as it enters the nip portion. Thus, the printing sheet is fed along a tilted traveling path provided by the pinch roller holder 23 and the sheet guide 70 so that the leading edge of the printing sheet is surely guided to the nip portion. The printing sheet fed by the main ASP 37 is brought into contact with the nip portion of the conveying roller 21, which is halted. At this time, since the main ASF 37 feeds the printing sheet a distance slightly exceeding the length of a predetermined traveling path, a loop is formed in the printing sheet between the feeding roller 39 and the conveying roller 21. Then, as the printing sheet attempts to return to its original flat shape, a force produced by the loop presses its leading edge against the nip portion and positions it parallel to the conveying roller 21, thereby completing the leading edge positioning operation.

When the leading edge positioning operation has been completed, the LF motor 26 begins to rotate in the direction in which the printing sheet is moved forward (the direction in which the sheet is moved toward the discharge roller 30). Thereafter, the force driving the supply roller 39 is halted and the supply roller 39 is rotated by the force of the friction between it and the printing sheet, while the printing sheet is fed only by the conveying roller 21 and the pinch roller 22. Then, for each scan the printing head performs, the printing sheet is moved forward a predetermined distance along a rib formed on the platen 29. Subsequently, the leading edge of the sheet reaches the first discharge roller 30, the first spur gear spring 32, the Second discharge roller 31 and the second spur gear spring 33, in the named order. In this feeding, since the peripheral velocities of the first discharge roller 30 and the second discharge roller 31 are set substantially equal to the peripheral velocity of the conveying roller 21, and since the conveying roller 21, the first discharge roller 30 and the second discharge roller 32 are coupled by gear arrays and are synchronously rotated, a constant tension force is applied to the printing sheet that is being fed.

The printing heads of the head unit 11 receive ink supplied through ink supply paths connected to corresponding ink tanks 12, and ink paths (nozzles) communicating with multiple orifices in the faces of the printing heads, which oppose the platen 29, are filled with the ink. In the vicinities of the orifices for the ink paths, ejection actuators are provided to generate ejection energy. In this embodiment, electric-thermal converting elements for employing the film boiling pressure produced by a liquid are employed as the ejection actuators. Other electric-pressure converting elements, such as piezoelectric devices, may also be employed. The printing heads receive drive signals from the head driver 307 via a flexible flat cable, and eject ink in accordance with printing data. Furthermore, the code strip 18 extended across the chassis 10 is read by the CR encoder sensor 19 mounted on the carriage 13, and the scanning printing heads can eject ink at appropriate timings. When the printing of one line is completed in this manner, the above described sheet conveying mechanism feeds the printing sheet a predetermined distance. By repeating these operations, printing can be performed across the entire face of a printing sheet.

When an ink tank 12 is replaced, the printing head maintenance unit 36 provides ink suction to prevent the clogging of the orifices of a printing head and to remove foreign substances, such as paper lint. To perform this process, the maintenance unit 36, which is located at a standby position for the carriage 13 to be opposed to the individual printing heads, includes caps (not shown), for contacting and covering the orifice faces of the printing heads, a wiper (not shown), for wiping the orifice faces, and a pump (not shown), which is connected to and generates a negative pressure inside the caps. For ink suction, a cap is brought into contact with the orifice face of each of the printing heads, and the pump is driven to generate a negative pressure inside each cap. Furthermore, the maintenance unit 36 includes a mechanism for moving the wiper parallel to, and in contact with, the orifice faces in order to remove ink therefrom after the ink suction has been applied, or to remove a foreign substance, such as paper lint.

The thus arranged ink jet printer according to the embodiment has, as one of its printing modes, so-called margin-less printing. In the normal printing mode, printing on a printing sheet is performed within an area within margins, whereas in the margin-less printing mode, there are no margins. For the ink jet printer, generally, an area N, shown in FIG. 2, for the orifices of the printing heads in the longitudinal direction, must be separated a distance L1 from the nip portion formed by the conveying roller 21 and the pinch roller 22; this distance cannot be made substantially 0. This is because the area having the length L is required to form the ink flow paths to the nozzles and to provide wiring for the ink ejection actuators. Thus, in the normal printing mode, a printing sheet is printed while it is sandwiched between the conveying roller 21 and the pinch roller 22. Thus, no printing is performed in the portion of the printing medium upstream, by the distance L1, of the nip portion at the conveying roller 21, and a margin having the width L1 is obtained in the feeding direction. On the other hand, in the margin-less printing mode, the printing sheet is moved away from the nip portion at the conveying roller 21, and the printing operation is continued while the printing sheet is sandwiched and conveyed only by the first and the second discharge rollers 30 and 31. Margin-less printing can therefore be performed.

In this embodiment, for the registration adjustment process, the printing sheet, on which registration patterns are printed, is fed in the direction opposite to that in which it is fed during the printing operation, and the registration adjustment patterns on the sheet are read. For this reverse feeding of the printing sheet, the two feeding paths are employed in consonance with the situation, so that the registration adjustment patterns can be printed within in a very large area (in this embodiment, an area almost the equivalent in size of a page) on a single printing sheet. At this time, the PE sensor lever is retracted from the substantially horizontal lower side feeding path within the above described two feeding paths, so that the PE sensor does not interrupt the reverse feeding of the printing sheet along the horizontal conveying path.

Generally, the PE sensor lever is attached at a predetermined angle relative to the face of a printing sheet and is capable of rotating, so that the positions of the leading and trailing edges of a printing sheet that is being fed in the normal sheet feeding direction can be correctly detected. Therefore, when a sheet is fed in the reverse direction, the edge of the printing sheet may be caught, or an end of the PE sensor lever may cut into the printing sheet. Thus, in this embodiment, when the horizontal feeding path is employed for reverse feeding, the PE sensor lever is retracted so it is separated from the feeding path.

Figure 4A:
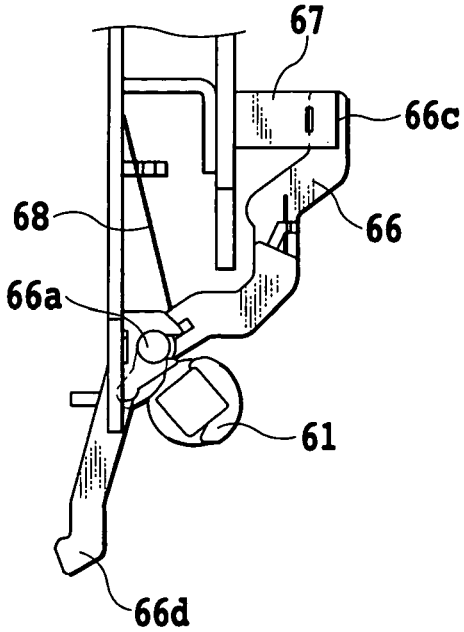
FIGS. 4A and 4B are diagrams for explaining the operation of the mechanism of the ink jet printer for retracting a PE sensor lever.
Figure 4B:
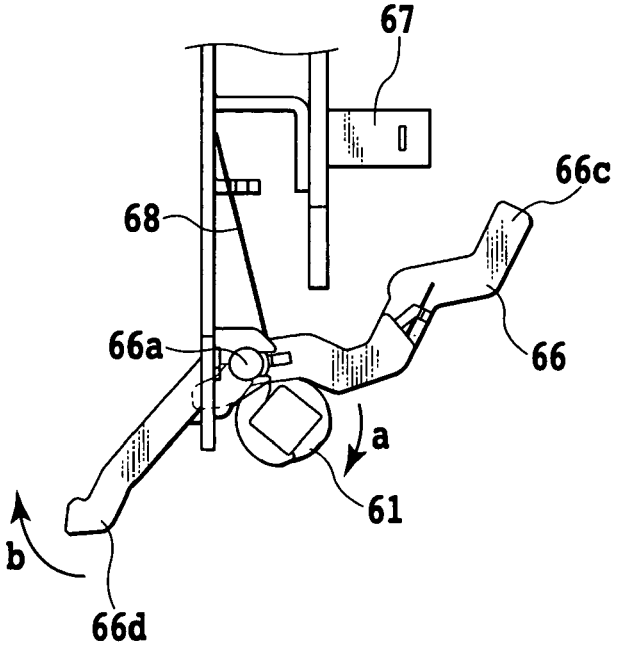

FIGS. 4A and 4B are diagrams for explaining the operation of a mechanism for retracting the PE sensor lever.

FIG. 4A is a diagram showing a PE sensor lever pressing cam 61, which is located at the initial position, and the PE sensor lever 66, which is in a free state. A shaft 66*a* of the PE sensor lever 66 is rotatably supported by a bearing portion of the chassis 10, and the PE sensor lever 66 is driven counterclockwise by a comparatively small force applied by a PE sensor lever spring 68. At this time, a blocking portion 66*c* of the PE sensor lever 66 blocks the optical path of the PE sensor 67. In this state, a printing sheet fed to the left in FIG. 4A is brought into contact with a contact portion 66*d* of the PE sensor lever 66, and passes while pressing against the contact portion 66*d,* countering the comparatively small force applied by the spring 68. As a result, the PE sensor lever 66 is rotated clockwise (the direction indicated by an arrow b in FIG. 4B), permitting light to be transmitted to the PE sensor 67, which thereby detects the presence of the printing sheet. By switching between light blocking and light transmission, the leading edge and the trailing edge of the printing sheet can be detected.

FIG. 4B is a diagram showing the state of the PE sensor lever 66 which is locked. That is, when the pressing cam 61 is rotated in the direction indicated by an arrow a in FIG. 4B, a cam follower portion of the PE sensor lever 66 is pushed upward, and the PE sensor lever 66 is rotated in the direction indicated by the arrow b in FIG. 4B. Therefore, the contact portion 66*d* of the PE sensor lever 66 is hidden in the pinch roller holder 23 (see FIG. 2), and when a printing sheet is fed in the reverse direction along the horizontal feeding path, it is possible to prevent the printing sheet from contacting the PE sensor lever 66.

Figure 5:
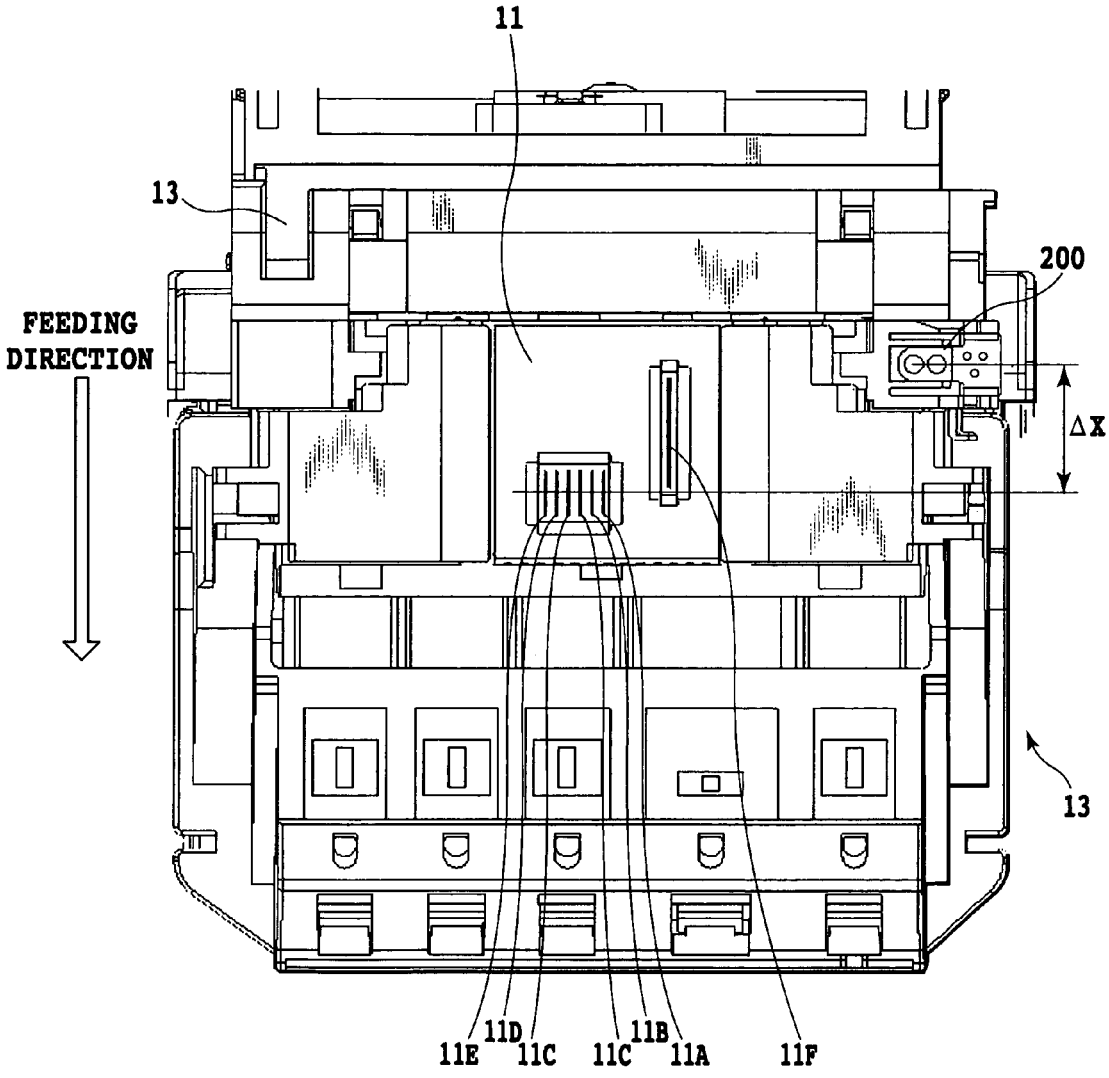
FIG. 5 is a diagram showing the positional relationship, for the ink jet printer, between orifice arrays of individual printing heads and a sensor for reading the densities of registration adjustment patterns.

FIG. 5 is a diagram showing the positional relationship between the orifice arrays of the individual printing heads and a sensor for reading the densities of registration adjustment patterns. Specifically, FIG. 5 is a diagram showing the carriage 13 viewed in the direction indicated by an arrow B in FIG. 1 (viewed from the bottom).

As is shown in FIG. 5, the head unit 11 is mounted on the carriage 13, and a density sensor 200 is located at the right end and an upstream side in the direction in which the printing sheet is fed. There is a distance ΔX between the centers of orifice arrays 11A, 11B, 11C, 11D and 11E of the individual printing heads and the center of the density sensor 200, and during the pattern reading process for registration adjustment, the printing head is reversely fed for the distance ΔX.

The density sensor 200, of a reflection type, irradiates the portion of a printing sheet wherein registration adjustment patterns are printed, and receives reflected light to detect the densities of the patterns. More specifically, while the head unit 11 is moved for scanning, a plurality of patterns are printed on a printing sheet by using all orifices of respective orifice arrays at different ejection timings, and thereafter, the printing sheet is reversely conveyed the distance ΔX. Further, while the carriage 13 is moving, the density sensor 200 detects the densities of the center portions of the individual patterns.

The printing of the registration adjustment patterns and the measurement of the densities by the density sensor 200 are repeated the required number of times. The ejection timing for a pattern for which the obtained density corresponds to a predetermined density is designated an appropriate election timing, and the registration adjustment processing is terminated.

As for the printing of registration adjustment patterns and the measurement of the densities, an explanation will now be given for the reverse feeding performed by the two feeding paths and for the printing area for the registration adjustment patterns.

When a printing sheet is fed back the distance ΔX along one of the two feeding paths, which is used for feeding from the ASF 37 (the upper feeding path in FIG. 2, referred to as a first feeding path), reverse feeding is inhibited after the trailing edge of the printing sheet has passed between the supply roller 39 and the separation roller 40 of the ASF 37. This is because the probability is increased that the printing sheet, when reversely fed, will contact, along the feeding path, components such as the return pawl 43 and the ASF flap 44, or the feeding roller 39 or the separation roller 40, and a paper jam will occur. That is, the reverse feeding of the distance ΔX is performed by using the first feeding path until the trailing edge of the printing sheet has passed between the supply roller 39 and the separation roller 40 of the ASF 37.

Figure 6:
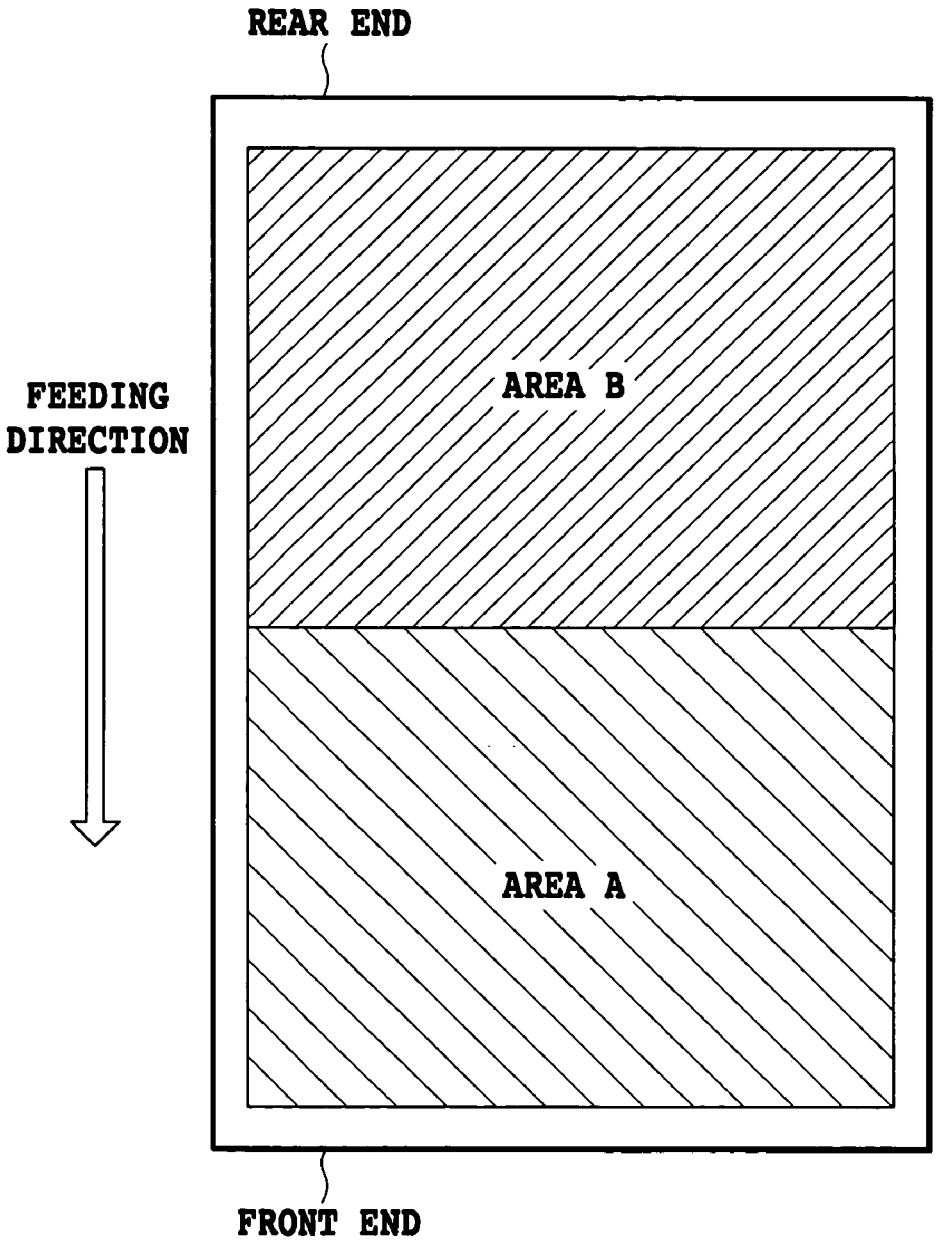
FIG. 6 is a diagram showing an area of a printing sheet wherein registration adjustment patterns can be printed during the registration adjustment process employing first and second feeding paths according to the first embodiment of the present invention.

An area A in FIG. 6 is a registration adjustment pattern printing area, the density of which can be measured by reverse feeding along the first feeding path. An area B is a registration adjustment pattern printing area for which the density can be measured by reverse feeding along a second feeding path, which is a lower side feeding path of the feeding path used for feeding from the ASF 37 (the lower conveying path in FIG. 2, including the downstream portion from the conveying roller 21 that is part of the first feeding path). For this area B, the PE sensor lever 66 must be retracted for reverse feeding.

FIGS. 7A to 7D are diagrams for explaining the registration adjustment process upon reverse feeding performed along the second feeding path with the PE sensor lever 66 retracted.

Figure 7A:
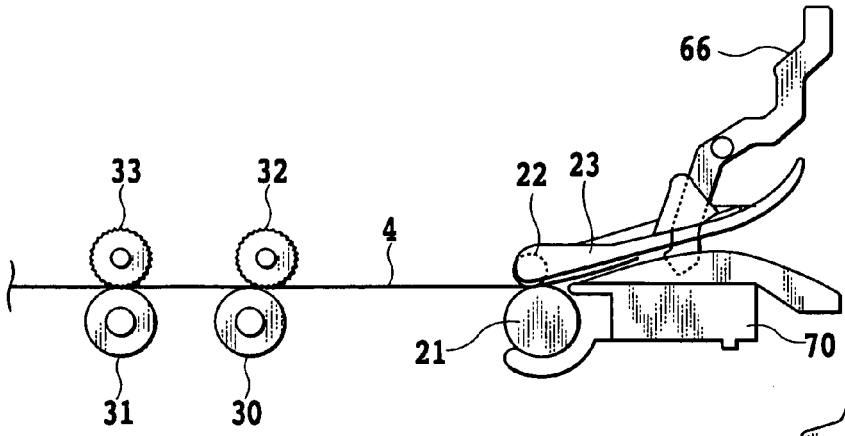
FIGS. 7A–7D are diagrams for explaining the registration adjustment effected by the reverse feeding along the second conveying path.

FIG. 7A shows a state after the registration adjustment patterns have been printed by the printing heads in the area A of a printing sheet 4, and following the reverse feeding, the densities of the patterns have been measured by the density sensor 200. This state is that the trailing edge of the printing sheet 4 is located downstream of the PE sensor lever 66. That is, when the printing of the registration adjustment patterns in the area A and the measurement of the densities have been completed, either the printing sheet 4 is still sandwiched between the supply roller 39 and the separation roller 40 of the ASF 37, or the trailing edge is about to be released therefrom, as is described above. Therefore, when the registration adjustment process for the area A is terminated, control is executed so that the printing sheet 4 is fed to the position shown in FIG. 7A. At this point, the printing sheet 4 is held at the nip portion formed by the conveying roller 21 and the pinch roller 22.

Figure 7B:
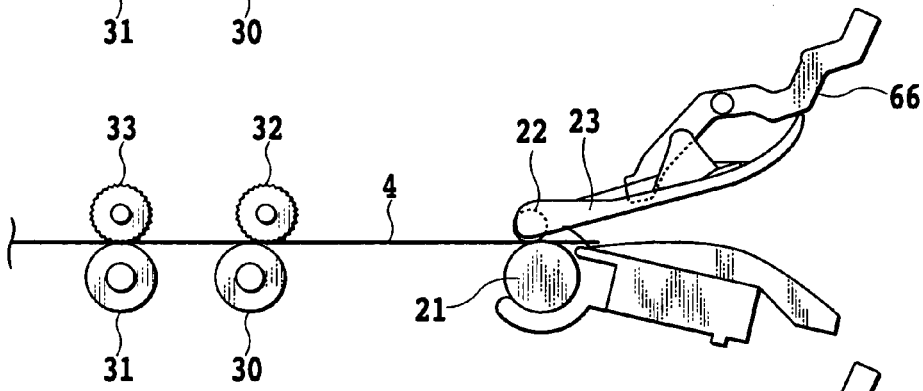
Figure 7C:
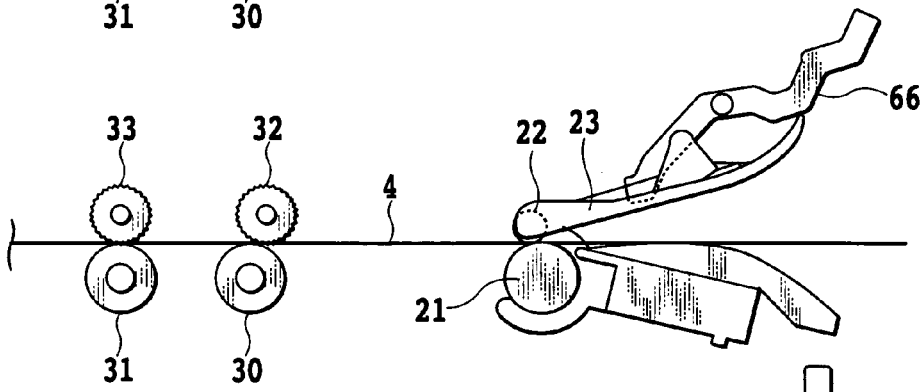

After the sheet 4 has been thus controlled to be fed, the PE sensor lever 66 is retracted as is shown in FIG. 7A. That is, the operation explained while referring to FIGS. 4A and 4B is performed, and the PE sensor lever 66 is hidden in the pinch roller holder 23. Therefore, when the printing sheet 4 is fed along the horizontal feeding path (the second feeding path) to the right in FIG. 7A (the reverse direction), the printing sheet 4 does not contact the PE sensor lever 66. Then, as is shown in FIG. 7C, the printing sheet in the state shown in FIG. 7B is fed in the direction indicated by an arrow (the reverse direction) along the second feeding path, which differs from the first feeding path of the ASF 37. Finally, as is shown in FIG. 7D, the PE sensor lever 66 is released from the retracted position, and is brought into contact with the printing sheet 4 located along the second feeding path.

Figure 7D:
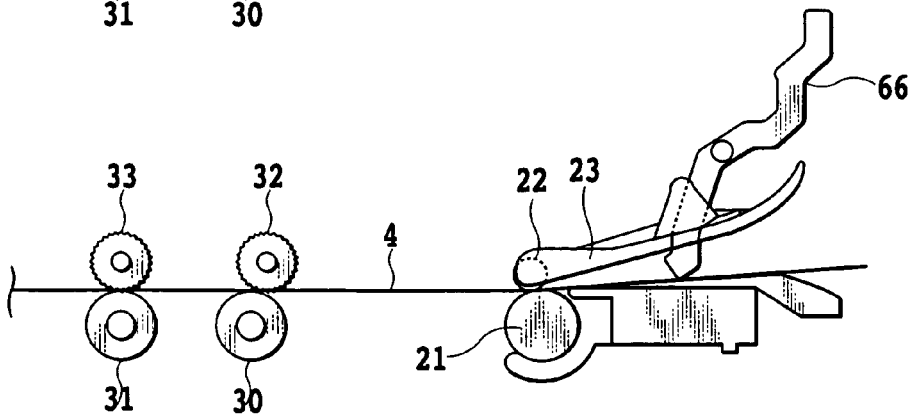

In this state, the printing sheet 4 is fed to the left in FIG. 7D (the forward direction), so that the area B for printing the registration adjustment patterns is adjacent to the area A, and the printing heads print registration adjustment patterns in the area B in order, beginning with the upstream portion. Then, the reverse feeding is performed the distance ΔX, and the registration adjustment pattern on the printing sheet is made positioned to be opposed to the sensor 200 for measuring the registration adjustment pattern. Subsequently, the printing of the registration adjustment pattern and the measurement of the densities are repeated, in the same manner, for the area B.

Since a well known art can be employed for specific contents of the patterns and the adjustment of printing positions based on the measurement results for the patterns, no detailed explanation for it will be given. For feeding controls for printing registration adjustment patterns and for measuring the densities, as explained while referring to FIG. 4A, the time when the trailing edge of the printing sheet 4 passes is set to be a reference point, so that the feeding distance from the nip portion formed by the conveying roller 21 and the pinch roller 22 in the direction indicated by an arrow along the second feeding path can be managed. In this case, according to the embodiment, a feeding path is provided along which the area B, which can be provided by feeding the sheet along the second feeding path in the direction indicated by an arrow, can at least overlap the area A.

In this embodiment, when automatic registration adjustment is to be performed for a printing sheet that does not have a sufficiently large area for the printing of registration adjustment patterns, the length of the sheet can be determined when the PE sensor detects the leading and trailing edges of the sheet along the ASF feeding path. When it is determined that the length of the sheet is insufficient, the printing sheet is forcibly discharged without performing the process for feeding the printing sheet to the second feeding path, and the automatic registration adjustment is forcibly terminated. When the automatic registration adjustment is performed for a printing sheet having a longer area than the area required for registration adjustment, the PE sensor detects the trailing edge of the printing sheet and the printing area from the trailing edge is obtained as the area for the automatic registration adjustment performed along the second feeding path. With this arrangement, when the automatic registration adjustment is performed for a printing sheet longer than necessary, a printing area insufficient for the first feeding path can be obtained along the second feeding path, so that the automatic registration adjustment can be performed without being affected by the length of the printing sheet.

As is described above, according to the embodiment, so long as a printing sheet is available that is long enough to obtain a printing area that is required for the automatic registration adjustment, the automatic registration adjustment can be performed without user's operation being required, and without increasing the size of the printing apparatus more than necessary.

The sizes of the areas A and B are not limited to the size for substantially one page shown in FIG. 6. In this embodiment, the registration pattern printing area, which tends to be insufficient for the reverse feeding along the first sheet feeding path, is compensated for by the reverse feeding along the second feeding path. It is apparent from the above explanation that for the invention, the sizes of the areas are not absolutely essential factors.

(Second Embodiment)

In a second embodiment, a feeding path for double-sided printing is employed to print registration adjustment patterns within a comparatively large area on a printing sheet, and to read the patterns.

Figure 8:
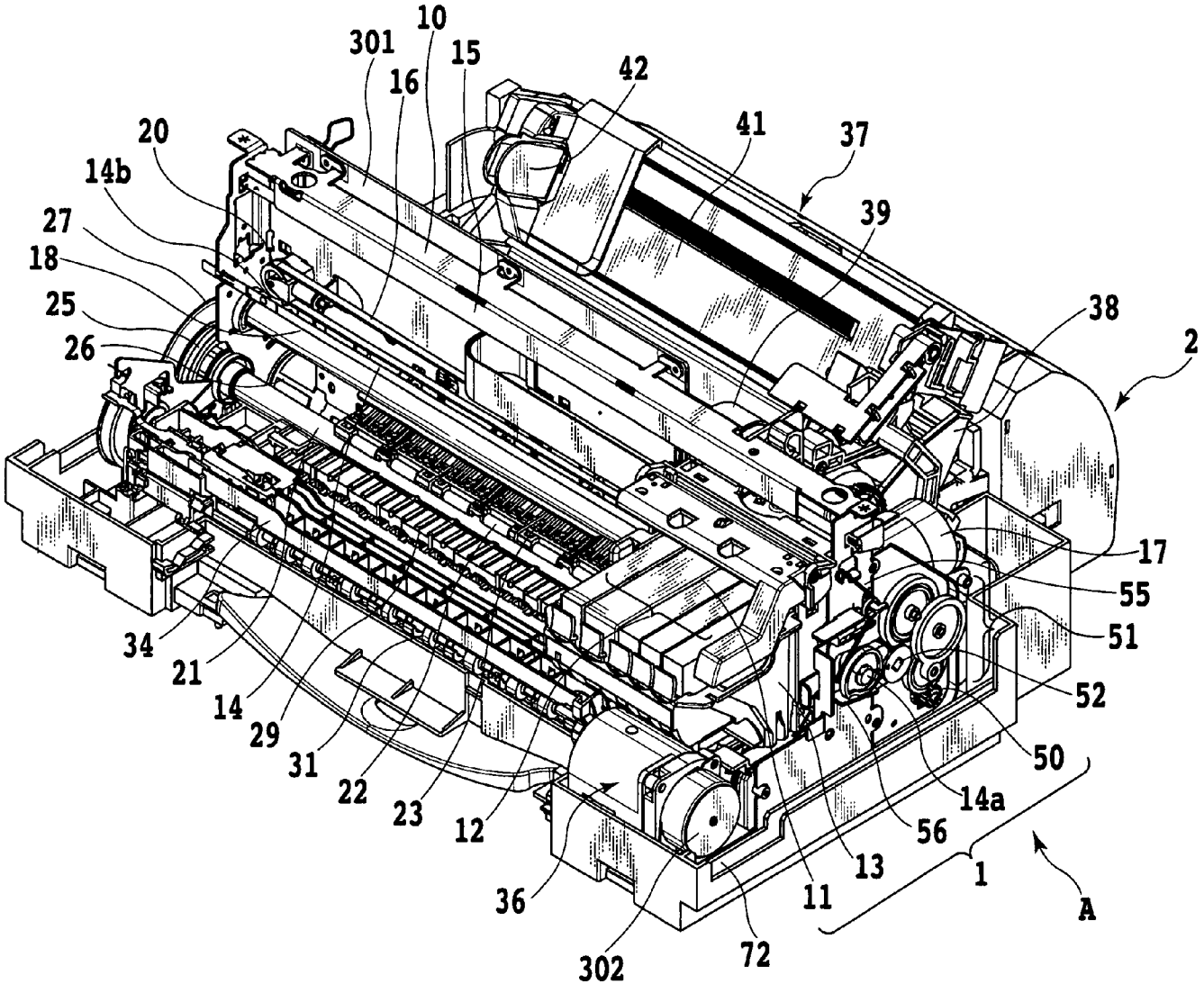
FIG. 8 is a perspective view of an ink jet printer according to a second embodiment of the present invention.
Figure 9:
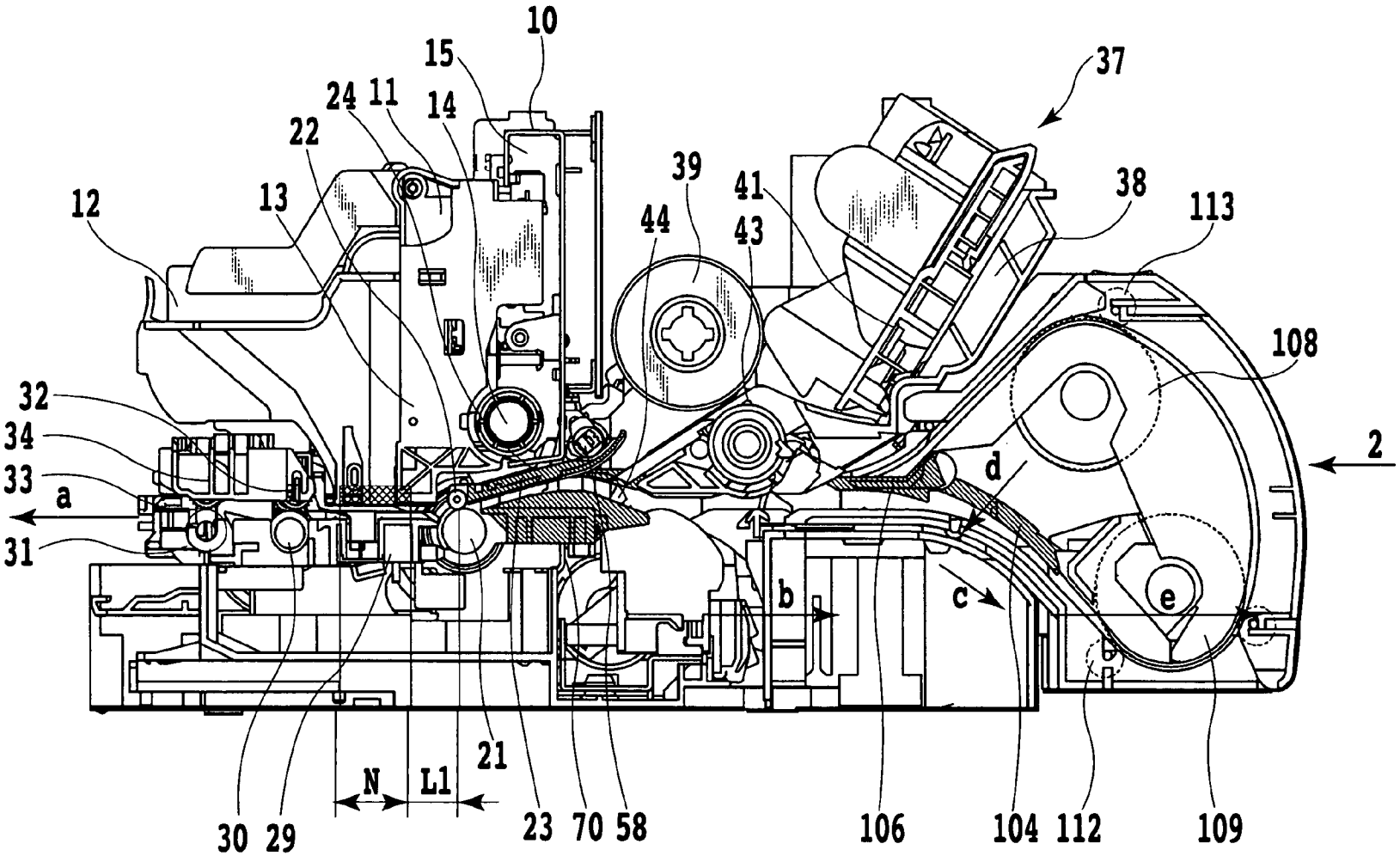
FIG. 9 is a side cross-sectional view of the ink jet printer viewed in the direction indicted by an arrow A in FIG. 8.

FIGS. 8 and 9 are views showing the ink jet printer in FIGS. 1 and 2 to which an automatic double-sided feeding unit 2 has been attached. In this embodiment, the second feeding path is employed as a feeding path used by the automatic double-sided feeding unit 2, and registration adjustment patterns on the entire area of a printing sheet are read by reverse feeding along this feeding path. That is, during the registration adjustment process, when a printing sheet is fed by the ASF 37, the registration adjustment patterns are not printed, unlike in the first embodiment (accordingly, reverse feeding is not performed), and only a check is performed to determine whether on the printing sheet an area for printing all the registration adjustment patterns is available.

First, a process for feeding a printing sheet using the automatic double-side feeding unit 2 will now be described.

The automatic double-side feeding unit 2 in FIG. 9 includes: a switching flap 104, which is rotatably supported and is used to determine the direction in which a printing sheet is passed through; an output flap 106, which is supported rotatably and is open or closed when a printing sheet is output by the automatic double-side feeding unit 2; a double-sided conveying roller A 108, for feeding the printing sheet inside the unit 2; a double-sided conveying roller B 109; a double-sided pinch roller B 112, which is rotated with the double-sided conveying roller B 109; and a double-sided pinch roller A 113, which is rotated with the double-sided conveying roller A 108.

When the printing operation is initiated, multiple printing sheets mounted on the main ASP 37 are separated and printing sheets are fed individually by the supply roller 39 or the like. The supplied printing sheet is sandwiched between a conveying roller 21 and a pinch roller 22, and is fed in a direction indicated by an arrow a in FIG. 9. While the printing sheet is being fed, the printing operation is performed in the same manner as in the first embodiment.

For the double-sided printing, after the printing of the obverse side of the printing sheet has been terminated, the printing sheet is fed by the conveying roller 21 and the discharge rollers 30 and 31 and the like in a direction indicated by a narrow b in FIG. 9, along a horizontal feeding path that is provided below the main ASF 37. This reverse feeding guides the printing sheet from the horizontal feeding path to the automatic double-sided feeding unit 2, where it is fed in a direction indicated by an arrow c in FIG. 9. In the double-sided feeding unit 2, the advancing direction is changed while the printing sheet is sandwiched between the double-sided conveying roller B 109 and the double-sided pinch roller B 112, and the printing sheet is fed in a direction indicated by an arrow d in FIG. 9 while sandwiched by the double-sided conveying roller A 108 and the double-sided pinch roller A 113. Finally, the advancing direction is changed 180°, and the printing sheet is returned to the horizontal feeding path. As a result, the printing sheet is inverted, and the reverse side of the printing sheet faces the scanning area of the printing heads. The printing sheet is again sandwiched by the conveying roller 21 and the pinch roller 22, and is fed in the direction indicated by the arrow a in FIG. 9 along the horizontal feeding path, and its reverse side is printed. As is described above, the printing sheet, the obverse face of which has been printed, is inverted by using the horizontal feeding path, which is located below the main ASP 37, and the automatic double-side feeding unit 2, which is located behind the main ASF 37, and the reverse side is printed. In this manner, double-sided printing is provided.

During the registration adjustment process in this embodiment, the printing sheet feeding by the automatic double-sided feeding unit 2 is employed to measure the densities of registration adjustment patterns. As in the first embodiment, the density sensor 200 of a reflection type, for measuring the densities, is provided for a carriage upstream of the orifice arrays of the individual printing heads.

During the registration adjustment process, first, a printing sheet is fed from the main ASF 37 and is fed until the trailing edge of the printing sheet has passed through a PE sensor lever 66. When it is determined, based on the detection by a PE sensor, that the printing sheet is not long enough for a required printing area to be obtained for registration adjustment, the printing sheet is discharged without any further process being performed, and the registration adjustment process is forcibly terminated.

When it is determined that the printing sheet is long enough for an area to be obtained for printing registration adjustment patterns, the printing sheet is reversely fed, instead of being discharged, and at a predetermined distance enters the automatic double-sided feeding unit 2, which serves as a second conveying path. Then, the printing sheet is fed a predetermined distance in the forward direction (indicated by the arrow a in FIG. 9), and a registration adjustment pattern for the first row is printed on part of the printing sheet. When this printing has been completed, the printing sheet is fed a distance ΔX in the reverse direction (indicated by the arrow b in FIG. 9), and the density sensor 200 detects the density of the registration adjustment pattern. At the time of or following this detection, a registration adjustment pattern for the second row is printed. The printing sheet is again fed the distance ΔX, and the density sensor 200 detects the density of this pattern. This operation is repeated a required number of times, and when the final density detection is completed, the printing sheet is discharged and the registration adjustment process is terminated.

In the above explanation, the printing of registration adjustment patterns and the measurement of the densities have been repetitively performed while a printing sheet is sandwiched by rollers. However, the operation is not limited to this. After a printing sheet has been introduced into the horizontal feeding path, all the registration adjustment patterns may be printed at one time on the areas A and B shown in FIG. 6, and the printing sheet may sequentially be reversely fed the distance ΔX to measure the densities of the registration adjustment patterns. In this case, since the printing and the measurement need not be alternately repeated, the period required for registration adjustment can be reduced. Furthermore, in this embodiment, the length of a printing sheet need not be detected before the printing for registration adjustment patterns is begun, and the unnecessary use of printing sheets can be prevented.

(Other Embodiment)

The above described embodiments relate to a printing apparatus that employs an ink jet printing head. However, it is apparent, from the above explanation, that the present invention is not limited to this type of apparatus. The present invention can be applied to not only a BJ ink jet printing apparatus used in the embodiments, but also a piezoelectric printing apparatus, or a printing apparatus of a thermal transfer type or a photosensitive type.

The present invention has been described in detail with respect to preferred embodiments, and it will now be apparent from the foregoing to those skilled in the art that changes and modifications may be made without departing from the invention in its broader aspects, and it is the intention, therefore, that the appended claims to cover all such changes and modifications as fall within the true spirit of the invention.

This application claims priority from Japanese Patent Application No. 2003-308005 filed Aug. 29, 2003, which is hereby incorporated by reference herein.

What is claimed is:

1. A printing apparatus that uses a printing head to perform printing on a printing medium which is fed, said apparatus comprising:

a first feeding path along which the printing medium is fed to perform printing on the printing medium;

a second feeding path including a part of said first feeding path and a feeding path different from said first feeding path;

feeding means for feeding the printing medium along said first and said second feeding paths;

detecting means for detecting an image printed on the printing medium on said first and said second feeding paths; and control means for controlling a registration adjustment process through which a printing position by the printing head is adjusted, said control means causing said feeding means to feed the printing medium along said second feeding path so as to print at least a part of a pattern image for the registration adjustment on the printing medium using the printing head, causing said feeding means to feed the printing medium along said second feeding path in a direction opposite to a direction in which the printing medium is fed for printing the pattern image so that said detecting means detects the pattern image printed on the printing medium, and executing a registration adjustment of the printing position by the printing head, based on a result of detection by said detecting means.

2. A printing apparatus as claimed in claim 1, wherein said control means causes said feeding means to feed the printing medium along said first feeding path to print a part of a pattern image for the registration adjustment on the printing medium using the printing head, causes said feeding means to feed the printing medium along said first feeding path in the direction opposite to the direction in which the printing medium is fed for printing the pattern image so that said detecting means detects the pattern image printed on the printing medium, and causes said feeding means to feed the printing medium along said second feeding path so as to print the rest of the pattern image, the part of which has been printed.

3. A printing apparatus as claimed in claim 1, wherein said control means causes said feeding means to feed the printing medium along said second feeding path so as to print all of the pattern image.

4. A printing apparatus as claimed in claim 1, wherein the printing head ejects ink to the printing medium for performing printing.

5. A printing position adjustment method for a printing apparatus that uses a printing head to perform printing on a printing medium which is fed, the apparatus including a first feeding path along which the printing medium is fed to perform printing on the printing medium, a second feeding path including a part of the first feeding path and a feeding path different from the first feeding path, feeding means for feeding the printing medium along the first and said second feeding paths, and detecting means for detecting an image printed on the printing medium on the first and the second feeding paths, said method comprising:

a control step for controlling a registration adjustment process through which a printing position by the printing head is adjusted, said control step causing the feeding means to feed the printing medium along the second feeding path so as to print at least a part of a pattern image for the registration adjustment on the printing medium using the printing head, and causing the feeding means to feed the printing medium along the second feeding path in a direction opposite to a direction in which the printing medium is fed for printing the pattern image so that the detecting means detects the pattern image printed on the printing medium; and an adjustment step for executing a registration adjustment of the printing position by the printing head, based on a result of detection by the detecting means, wherein said control step causes the feeding means to feed the printing medium along the first feeding path to print a part of a pattern image for the registration adjustment on the printing medium using the printing head, causes the feeding means to feed the printing medium along the first feeding path in the direction opposite to the direction in which the printing medium is fed for printing the pattern image so that the detecting means detects the pattern image printed on the printing medium, and causes the feeding means to feed the printing medium along the second feeding path so as to print the rest of the pattern image, the part of which has been printed.

* * * * *

UNITED STATES PATENT AND TRADEMARK OFFICE

CERTIFICATE OF CORRECTION

PATENT NO. : 6,991,387 B2
APPLICATION NO. : 10/925973
DATED : January 31, 2006
INVENTOR(S) : Akira Kida It is certified that error appears in the above-identified patent and that said Letters Patent is hereby corrected as shown below:

COLUMN 4
Line 9, "and" should read --an--.

COLUMN 5
Line 21, "rotatable" should read --rotatably--.

COLUMN 7
Line 59, "Second" should read --second--.

COLUMN 12
Line 67, "a narrow" should read --an arrow--.

Signed and Sealed this

Seventh Day of August, 2007

JON W. DUDAS
*Director of the United States Patent and Trademark Office*